United States Patent [19]

Johnson

[11] Patent Number: 4,750,330

[45] Date of Patent: Jun. 14, 1988

[54] RECOVERY AS HYDROELECTRIC POWER THE ENERGY LOST IN STEAM CONDENSATION

[76] Inventor: Arthur F. Johnson, 240 Fox Dr., Boulder, Colo. 80303

[21] Appl. No.: 36,212

[22] Filed: Apr. 9, 1987

[51] Int. Cl.[4] ..... F01K 17/00

[52] U.S. Cl. ..... 60/715; 60/685; 60/692

[58] Field of Search ..... 60/685, 690, 692, 715

[56] References Cited

U.S. PATENT DOCUMENTS 1,614,962 1/1927 Koenig ..... 60/516

4,109,470 8/1978 Cassidy ..... 60/685

4,195,481 4/1980 Gregory ..... 60/516

4,270,350 6/1981 Chevalier ..... 60/516

*Primary Examiner*—Allen M. Ostrager

*Attorney, Agent, or Firm*—Pennie & Edmonds

[57] ABSTRACT

An apparatus for recovering mechanical energy from the exhaust steam from a power plant is disclosed. The exhaust steam is led to a generally U-shaped sealed reservoir containing two legs filled with water. The water is driven back and forth between the legs causing the exhaust steam to condense while generating energy from the oscillating water in the reservoir.

13 Claims, 6 Drawing Sheets

RECOVERY AS HYDROELECTRIC POWER THE ENERGY LOST IN STEAM CONDENSATION

BACKGROUND OF THE INVENTION

The invention relates to the recovery of energy now lost in power plant steam condensers where in the order of 300 tons of cooling water from lakes or streams is used per ton of coal burned. Consequently power plant efficiency runs about 35% to 45% of that theoretically obtainable. Although great strides have been made in improving power plant efficiency by the use of higher and higher steam pressures and superheating to avoid condensation of steam in turbines, little progress has been made in making low pressure steam as efficient in producing electricity as high pressure steam. In 1698 Thomas Savery was granted a patent for "raising water and occassioning motion to all sorts of mill works by the impellant force of fire". The key to raising water with steam is that when steam condenses in a closed vessel it leaves a vacuum. Thus at sea level with 14.7 pounds per square inch absolute pressure the vacuum will lift cold water about 34 feet. The real significance of this phenomena was lost sight of as the diameter and length of steam cylinders grew to about the limit foundry and machine shops could produce, and compact rotary pumps and turbines replaced cylinders. However, the early pump makers did demonstrate they could get better efficiency in pumping if, by the means of counter weights or flywheels, they extended piston stroke beyond that which their steam pressure would push the piston. This demonstrated the importance of kinetic energy.

SUMMARY OF THE INVENTION

This invention discloses what has long been overlooked, that steam vapor no matter how low in pressure, will upon condensing leave a vacuum which at sea level will lift water 34 feet and the energy in a square foot column of water so raised is the weight of water times its average height which is $62.4 \times 34 \times 17 = 36{,}067$ foot pounds for 34 cubic feet of vacuum space or 1060.8 ft. lbs/cu ft. If this lifting of water is done once per second, the equivalent potential energy in terms of heat energy is 1060.8/778 or 1.363 Btu per cu. ft. of water displaced by vacuum per second. Referring now to steam tables wherein one pound of saturated steam at 212° F. has an absolute pressure of 14.7 lbs per sq. in and the saturated vapor has a volume of 26.78 cu ft. and a heat of evaporation of 970.3 Btu which is conventionally lost condensing the steam in the coldest water available to the power plant; this invention conceives that if a pound of this steam could be expanded 970.3/1.363 or to about 712 cu ft. in a second the heat of condensation might be converted to hydroelectric power instead of being lost in condenser water. Steam tables show a pound of steam having a volume of 764.1 cu ft. has a temperature of 74° F. and a heat of condensation of 1051.8 Btu. Dividing 1051.1 by 1.363 shows an expansion to 771 cu ft. close to the above 764.1. Such quick expansion causes implosion. Of course, steam at these low pressures and temperatures is wet steam and conditions are better seen from a temperature entropy diagram for steam. Some molecules have slower velocities and condense first thus releasing their latent heat to produce wet steam droplets.

The apparatus disclosed by this invention to quickly expand, with minimal friction and heat loss, the enormous amounts of steam now wasted in condensers of power plants is, in its most elementary form, a U-shaped tube or vessel half filled with water and closed on both ends and both arms evacuated of air to start, and thereafter incremental amounts of steam added to first one arm and then the other to produce an undulating motion similar to a piston. To make the movement have minimum friction tube diameter may be 20 or more feet and length 100 feet but natural frequency of oscillation decreases with length. To reduce construction cost and conserve heat the vessel is made of light-weight concrete. To allow low pressure steam to move large volumes the U-tubes may be sloped, for example, at a ratio of 1:3. where atmospheric pressure steam applied on one arm will move water roughly 100 feet into the evacuated other arm. Stainless steel or insoluble plastic must be used to line such vessels because it is imperative that condensate returned to boilers not be contaminated with anything to damage boiler tubes operating at red heat.

Low-head hydroelectric generators mounted in the oscillating flow-stream between the U-tube arms make electric power. This is implicit from the law of conservation of energy since by this invention the power plant steam cycle is now a closed system. In large power plants currently having 35% to 45% efficiency apparatus of this invention can improve efficiency to 75% to 85%. The above simple calculations illustrate this.

DESCRIPTION OF THE PREFERRED EMBODIMENTS

The invention has several features, each of which, has such beneficial features in energy conservation that it could be considered preferred in the aspect covered. By the following description of the invention through reference to the drawings those wishing to practice the invention will better understand its various aspects.

Figure 1:
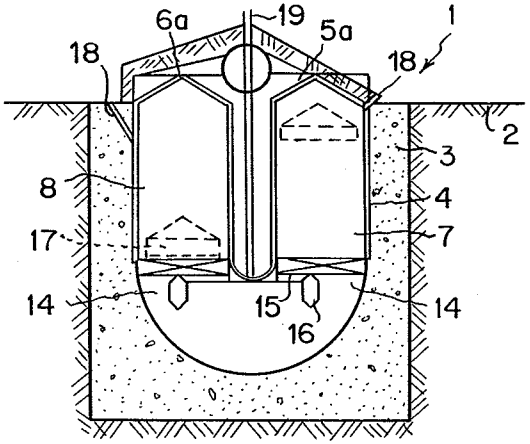
FIG. 1 is a vertical cross section through a vessel of the invention having a U-tube shape for converting vapor to hydroelectric power.
Figure 2:
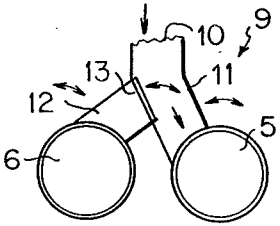
FIG. 2 is a plan view of FIG. 1 with the heat insulation removed from conduits supplying vapor to the ends of the U-tube.

FIG. 1 is a vertical cross section through a U-tube about half full of water, and FIG. 2 is a plan view of FIG. 1 with heat insulation removed to show steam ducts leading to the top of each arm of the U-tube.

In FIG. 1 the large U-shaped vessel 1 is made by excavation in the earth 2 and shaped or formed by casting light weight, heat insulating concrete 3, lined with stainless steel 4 and tightly covered by caps 5*a* and 6*a* which seal U-tube openings 5 and 6 when closed and when open communicate with a duct system for supplying steam shown as 9 in FIG. 2 duct 11 periodically allows first U-tube arm 7 to receive via cap 5*a* and aperature 5 an incremental amount of steam and then U-tube arm 8 via cap 6*a* and aperature 6. This produces an undulating motion of the water in the U-tube so that it fills first arm 8 and then arm 7. In this undulating process each incremental amount of steam drawn in is just that amount that will expand enough to cool and hence condense the steam completely and occassion implosion to a vacuum condition. FIG. 2 shows in simplistic manner how steam direction may be regulated. In duct system 9, the duct 10 from a conventional steam turbine exhaust branches into 11 and 12. The damper 13 allows steam via duct 11 to enter U arm 7 and then 8. Undulation of the water produces enormous amounts of kinetic energy which is absorbed by either novel or conventional, low-head hydroelectric generators 14 consisting of an automatically adjustable turbine runner 15 and electric generator 16. Loss of heat from the U-tube power system is minimized by heat insulation covering the duct system and the heat insulating concrete 3. The light weight floats 17, which are covered with stainless steel or insoluble plastic, are only necessary when undulation is slow enough to possibly necessitate removing condensate quickly. Otherwise the expansion should be so fast and so extended that condensate is chilled to the temperature of the undulating water. Then, being a closed heat system, the hydroelectric power generated must equal the heat of condensation in steam which is on the order of 1000 Btu per lb. of steam.

Pipes 18 are used for purging gases such as air by vacuum means. This is always necessary when starting the undulations after a shut-down. A vertical pipe 19 is necessary to withdraw condensate continuously to forward it to the boiler feedwater pump system. A submersible pump is used in pipe 19 for ease in rapid replacement for repairs.

Figure 3:
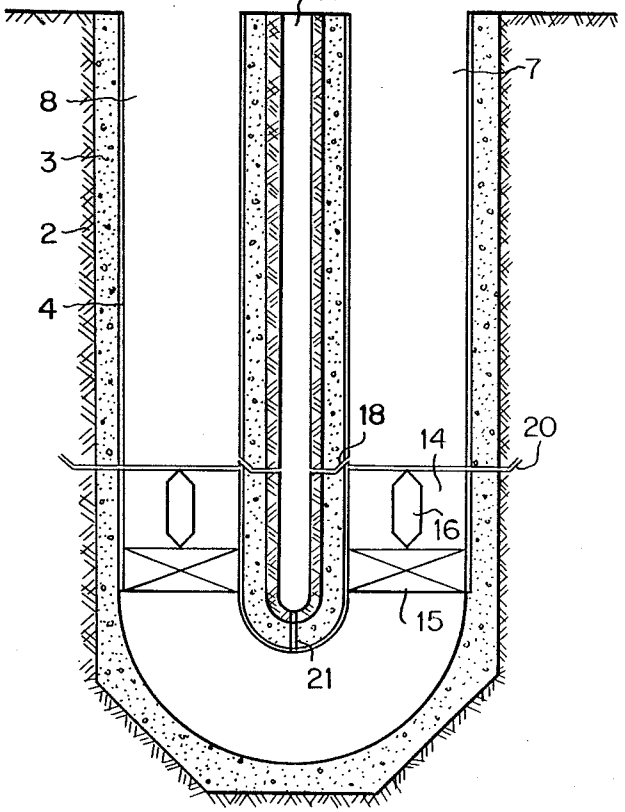
FIG. 3 is a vertical section through a second U-tube shaped vessel having greater length of tube than tube diameter than FIG. 1.

In FIG. 3 the proportions of arm diameters to length are illustrated. Longer arm lengths are possible with forced oscillation frequency as distinguished from natural harmonic oscillation where short arm lengths are required. Space between arms 19 is large enough for an elevator or manway and likewise large enough for power conduits 20 shown passing through concrete 3 and earth 2 shown going upwardly.

Figure 5:
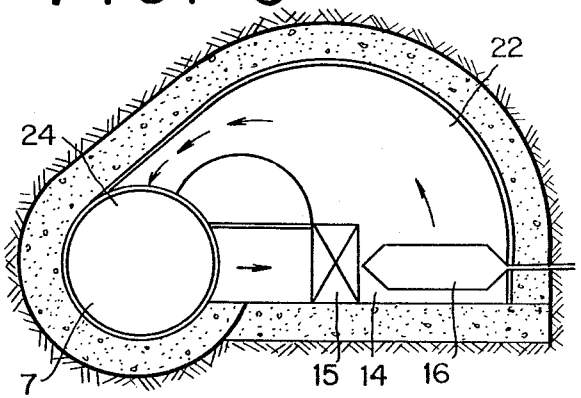
FIG. 5 is a horizontal cross section through A—A of FIG. 4 showing how the exhaust stream from the hydroelectric unit enters the base of the U-tube at right angles to the oscillating flow stream.
Figure 4:
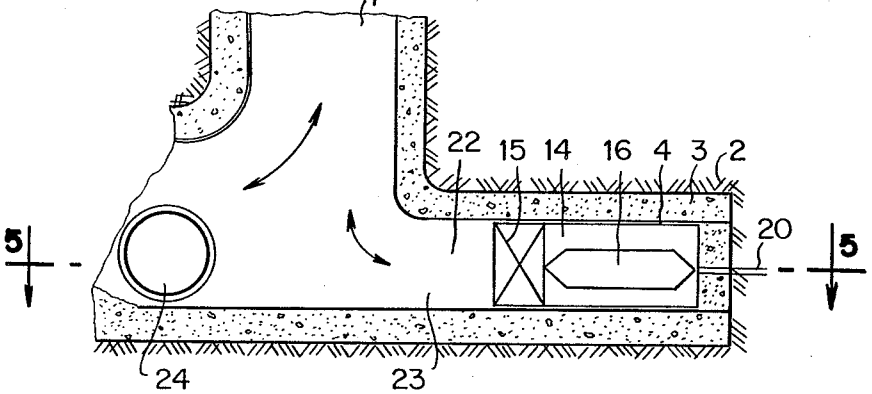
FIG. 4 is a variation of the design of FIG. 3 in which the lower right portion of the U-tube base has an extension horizontally to convert some of the momentum of the oscillating stream to hydroelectric power.

FIGS. 4 and 5 are respectively a vertical and horizontal cross section of concrete formed tubes off the base of a U-tube. These tubes are lined with stainless steel or coated with insoluble plastic. Obstructions to the water undulating in the U-tube portion are avoided by placing a hydroelectric generator 14 in a semicircular conduit 22 extending from the base of the U as portal 23 and reentering at about the centerline of the U-tube base via exit portal 24. As can be seen from the arrows indicating direction of water flow, part of the kinetic energy of the undulations is throtled to higher velocity and directed into the turbine while the undulations, being at right angles to the exit portal 24, help evacuate turbine discharge flow by well known laws of fluid mechanics. Since water velocity is increased by the square of duct diameter, smaller but higher head pressure turbines may be used.

Figure 6:
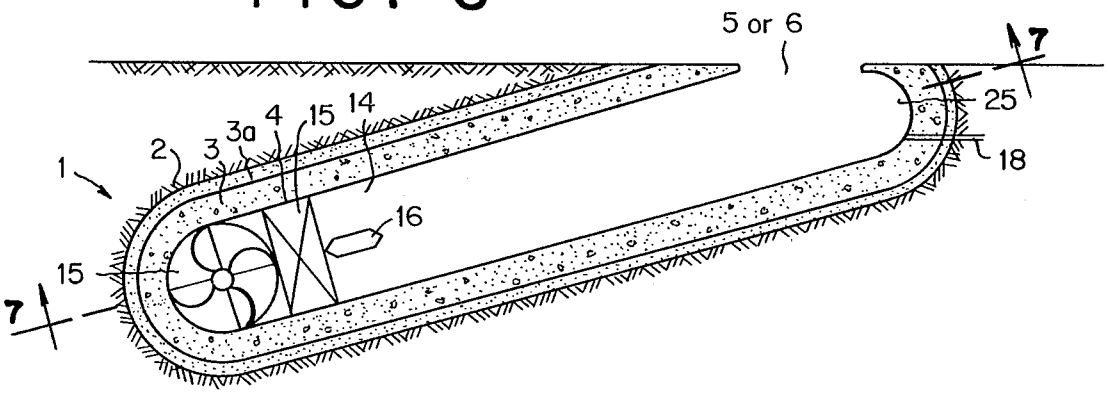
FIG. 6 is a vertical cross section through the centerline of one arm of a U-tube which slopes about 1:3 from ground level.

FIGS. 5, 6, 7 and 8 represent a design wherein low pressure vapors can readily move huge volumes of liquid but necessarily must sometimes have a forced speed of undulation (as distinguished from natural harmonic frequency) because of their length in proportion to diameter. As shown in FIG. 6 the U-tube branches slope about one foot vertical to three feet horizontal making a 3.16 foot hypotenuse and a length of $34 \times 3.16 = 107.4$ ft. length of water which steam at 14.7 psia (atmospheric pressure) can lift.

Figure 7:
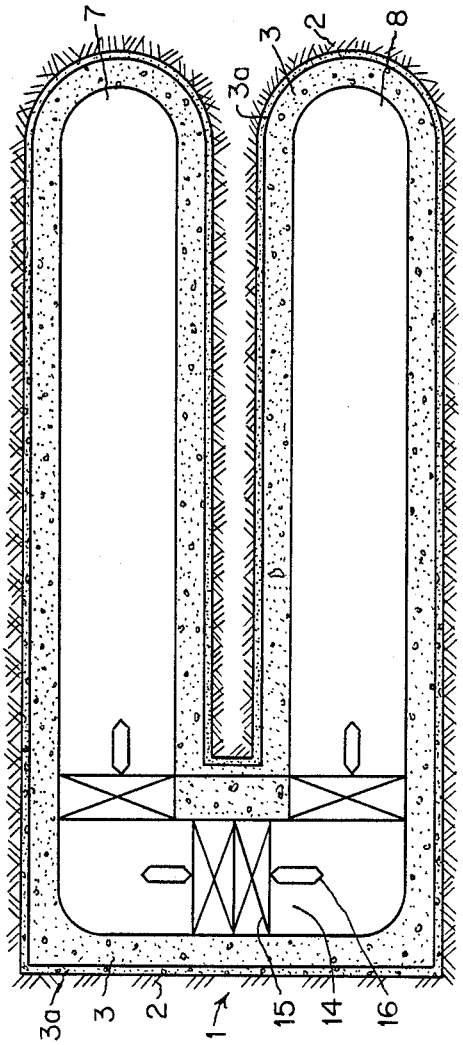
FIG. 7 is section through FIG. 6 on A—A to show both arms of the U-tube.

In FIG. 6 the U-tube has a reenforced concrete shell 3*a* having prestressed cables therein to prevent cracking. FIGS. 6 and 7 show four hydroelectric turbines 16 in series to allow power to be absorbed from the fast undulations without exceeding the stress limits of the long rotating blades usually permitting speeds of only a few revolutions per second. The Kaplan type blade in wide usage is automatically adjustable from a flat position at no load to a steep angle at full load and allows flowstream reversal but perhaps not quickly enough for this service without redesign.

FIG. 7 is a cross sectional view of the U-tube taken through A—A of FIG. 6 wherein the undulating water length has been made roughly three times the vertical depth indicated in the vertical section of FIG. 6.

Figure 8:
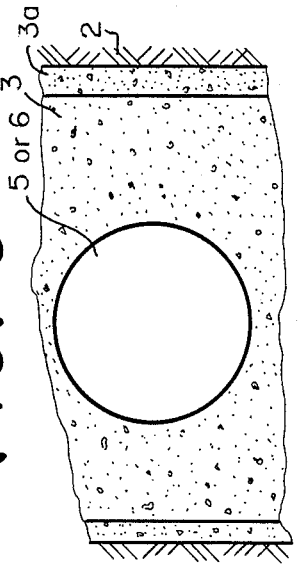
FIG. 8 is a plan view of the ground surface exposure of one arm of FIG. 7 or FIG. 6.

FIG. 8 shows in plan view the surface aperatures 5 and 6 are made circular in cross section to mate with ducts the same 10 ft. diameter from conventional steam turbine conduits to condensers.

Figure 9:
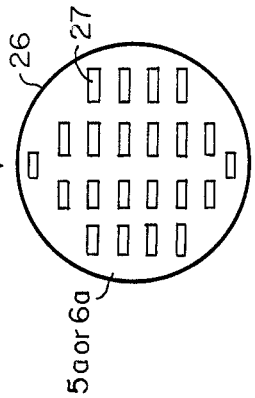
FIG. 9 is a plan view of one of a pair of metal plates having a multiplicity of elongated slots which act as valve openings when a small sliding movement makes openings coincide.

FIG. 9 illustrates in a face view, a sliding valve plate 26 intended, like 5*a* and 6*a* of FIG. 1 to allow steam to enter first one tube and then the other. This design uses a multiplicity of parallel slots only a few inches wide and spaced a slightly greater distance apart so a pair of such plates, where the lower one is stationary, can be opened in a split second by moving the upper plate a few inches so the slotted openings for steam entry match. Such valve plates must be made of self lubricating material not corroded by steam. Thus graphitic cast iron rubbing on stainless steel or teflon would have low friction.

Figure 10:
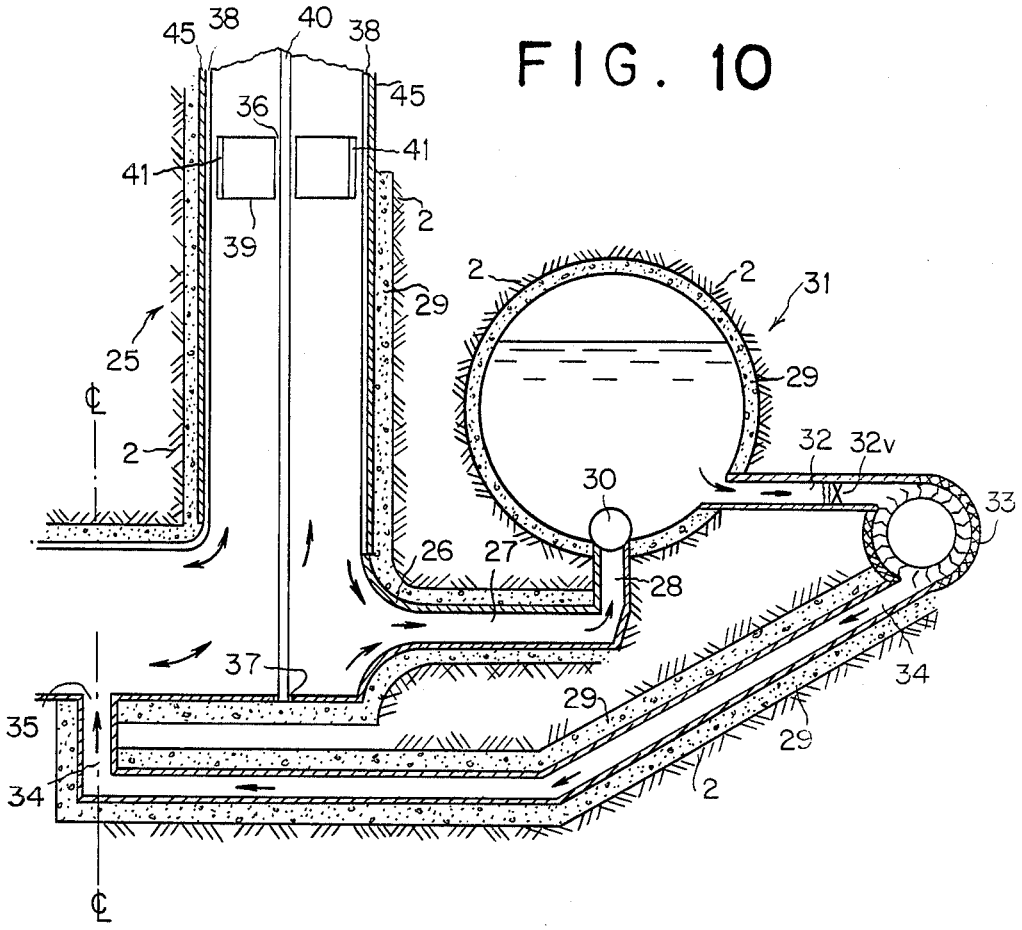
FIG. 10 is a vertical section through another novel U-tube wherein part of the oscillating flowstream is routed to a liquid storage tank under air pressure for use in hydraulically operated tools at distant locations.

FIG. 10 is a vertical cross section through a U-tube 25 of the invention which has two principal novel features.

Firstly, part of the kinetic energy of the oscillating water is diverted to a water reservoir 31 under air pressure so water drawn off via pipes or pressure hoses 32 can operate hydraulic machinery located some distance therefrom. Secondly, in FIG. 10 the U-tube 25 has electrical wire windings around its periphery and contains a float with a multiplicity of magnets thereon whose lines of magnetic force induce current in the windings thus making the U-tube itself an electric generator without having conventional hydroelectric turbines obstructing the undulating mass, but this feature is not necessarily suitable for large installations simply because a light-weight float may not impede and regulate the undulating flow frequency of undulation which heavy currents must do.

In FIG. 10, 25 is the U-tube arm 7 in vertical cross section. It has at one end of its extended base a curving entry 26 to divert the undulating water and speed it by throttling in duct 27 thence up heavy pipe section 28 with its ball socket, which, with ball 30 constitutes a one-way pressure valve in the bottom of water reservoir 31 that is always under pressure due to compressed air above the water level as shown. Water under pressure is drawn off through pipe or pressure hose at times and in quantities desired through valve 32*v*, which may be remote controlled, to operate the positive displacement turbine 33 or piston that might be attached to a crank shaft, and thence via exhaust pipe or hose 34 to the base of the U-tube which it meets at right angles to undulating flow to get a desirable evacuation effect. With U-tubes of this invention the feature of FIG. 10 above described allows railroad coal-fired steam engines to apply positive displacement to wheels or large trucks operated with coal-fired steam engines. Similarly ships may operate their propellers in this manner.

Figure 11:
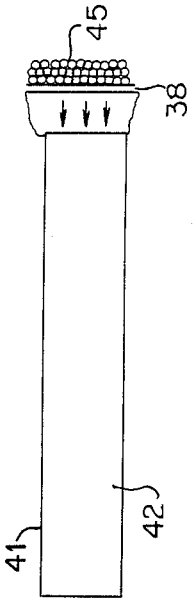
FIG. 11 is a vertical section through a magnet and coil of wire located respectively on a float in an arm of a U-tube and around a paramagnetic wall of the U-tube making the U-tube itself an electric generator.
Figure 12:
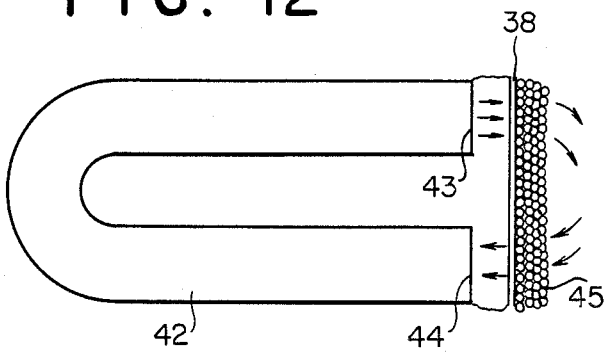
FIG. 12 is a side view of FIG. 11.

A second novel feature of FIG. 10 and also FIGS. 11 and 12 is the float 39 made of aluminum with just enough sealed float chambers that only its top edge surfaces. It has a central tube 36 and socket 37 that keeps it accurately centered in the U-tube by the center-line shaft 40 through which 36 passes. Around the periphery of the U-tube float 39, are mounted layers 41 of permanent magnets 42 having north and south poles 43 and 44 producing magnetic lines of force which cut the windings of electric wire 45 wound around the aluminum wall 38 of the U-tube. As the float moves upwards and downwards current is generated in the windings 45. FIG. 11 is a top view and FIG. 12 a side view of these magnets. The spacing between the magnet faces 43 and 44 and the nearest winding should not exceed one half inch. Aluminum is necessary for the construction of both float and U-tube walls 38 because it is paramagnetic. Instead of permanent magnets the float may have merely iron poles which vary the magnetic reluctance of electromagnets mounted around the periphery of the outside of the aluminum tube 39 as in conventional electric generators having "revolving fields" instead of revolving armatures. Although this invention anticipates water may be kept as low as 70° to 80° F. heat insulation 29 is shown in the drawings to avoid heat loss and so all energy is withdrawn as electric power.

Mixtures of water with substances which are soluble therein and have higher vapor pressures at ambient temperature like ammonia and alcohol, or instead, common refrigerants themselves, may be used by this invention to vaporize, from heat exchange with air or water in lakes or the sea, and may then be expanded in a undulating U-tube to incipient condensation or implosion to produce mechanical power or hydroelectric power. As a practical matter the huge expansions required with the less expensive refrigerants such as ammonia and sulphur dioxide must be done as a matter of safety in underground U-tubes or in ocean vessels where the outer surface of the vessel is extensive enough to evaporate large quantities of the refrigerant and where the U-tubes may be made long and of large diameter.

This invention discloses the advantage of tapering each arm of the U-tube to a smaller cross section at the top since then the arm to which vapor is added falls with much higher velocity than the liquid rises in the bottom of the opposite arm. This is important since velocity starts from zero at undulation reversal and reaches a maximum when liquid levels in the arms are momentarily equal. While cone shaped tubes are some improvement, the ultimate in technical and economic effectiveness must be the objective in engineering, and the following design appears better than cone shapes.

Figure 13:
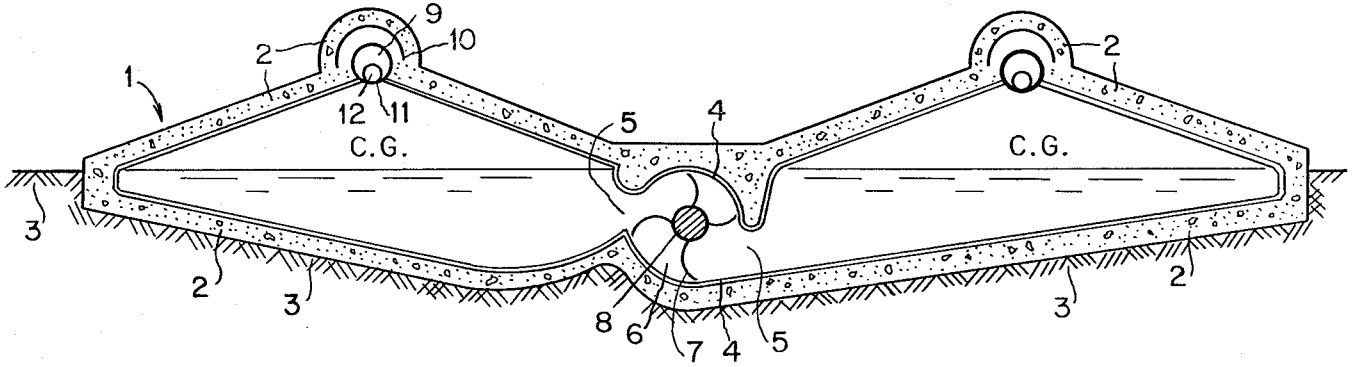
FIG. 13 is a vertical cross section through A—A of FIG. 14 of a basin-shaped vessel with a pair of sloping roofs covering it wherein a liquid may be very rapidly oscillated at natural frequency by adding vapor at harmonic intervals at the peak of first one roof and then the other.
Figure 15:
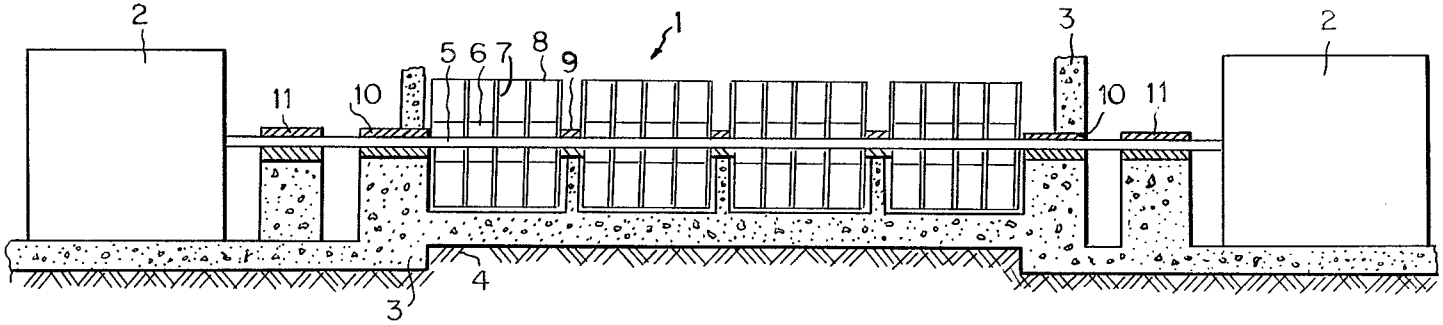
FIG. 15 is a longitudinal, vertical cross section through the turbine wheel 6 of FIG. 13 and taken through A—A of FIG. 14.
Figure 14:
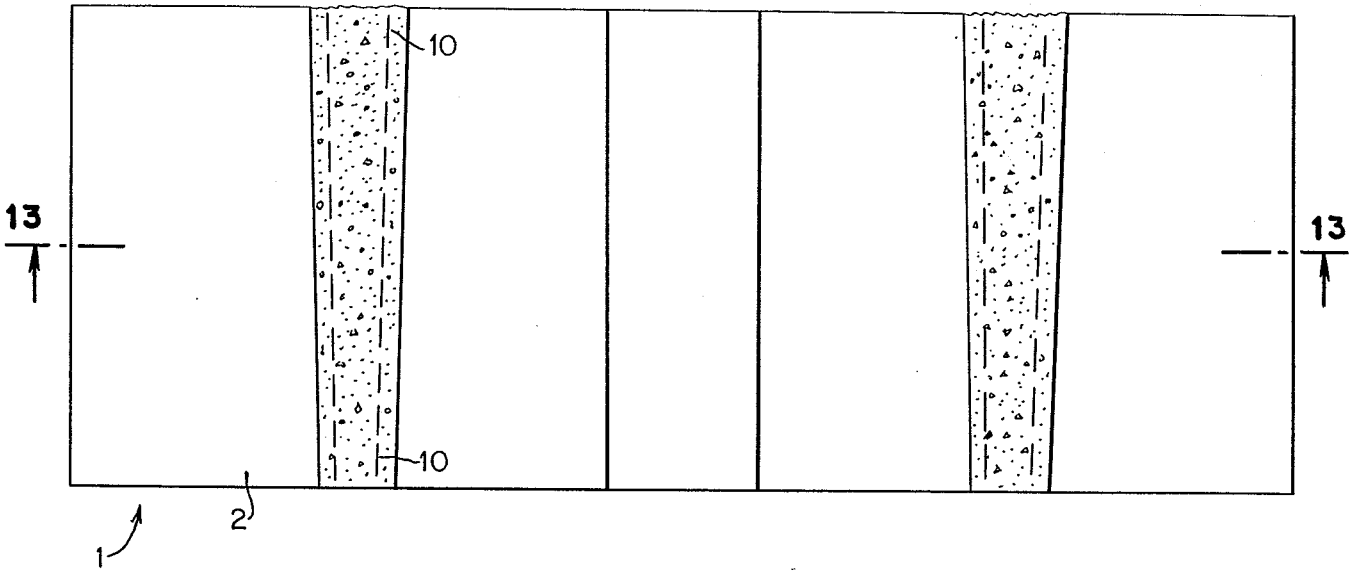
FIG. 14 is a plan view of FIG. 13 showing how the vessel is elongated to take large quantities of vapor along the roof peaks

FIGS. 13, 14 and 15 show by cross sections and plan view an aspect of the invention which has some important advantages in construction costs, fast oscillation and novel hydropower turbine blades which rotate in the same direction when the water oscillates from right arm to left arm or oscillates from left arm to right arm and rotates at speeds consistent with stress capabilities of turbine blades.

In these Figs. 1 is the pair of elongated basins, each tightly covered with elongated, sloping roofs. These function as U-tubes which have fast harmonic motion due to the low fall and rise of the centroid (center of gravity) of the displaced water. In FIG. 1 the pools of water are shown with the water levels equal and so inoperative or at maximum velocity. The basins and roofs are formed of 2, a light-weight, heat-insulating concrete with inner coating of stainless steel or heat resistant plastic. All of the structures may be buried in the earth 3 or only the lower parts as shown. Of course, the weight of lightly cemented and compacted earth helps resist the alternating forces of vacuum and steam pressure thus lessening the costs of more highly reenforced concrete structures. The basins are joined at their bases by the elongated, covered channel 4 likewise formed of reenforced concrete but lined in all cases with stainless steel to withstand the washing action of the rapidly surging stream of water through the downwardly throats 5 whose configuration directs the water rushing downwardly out of the left arm then upwardly into the turbine wheel 6, made of stainless steel, and then directs the water rushing out of the right arm downwardly into the turbine wheel. Accordingly a turbine scoop or blade 7 attached to the shaft 8 receives the water impulse force against its scoop-shaped face from the water rushing from the emptying basin and then receives the reaction force against its scoop-shaped face from the water leaving it to fill the opposite basin. Since the turbine shaft 8 with its attached scoops extends the entire length of the basin, and the water flow is throttled only at throats 5, stresses on turbine parts are not excessive.

The low pressure steam from which hydroelectric power is produced by this apparatus enters via heat-insulated, tapered steam pipe assembly 9 wherein 10 is the fiberglass insulated, tapered, stainless steel steam pipe, 2 is a heat-insulated concrete covering not attached to the pipe, 11 is a succession of crack-thin openings on the bottom of pipe 10 extending throughout its length to provide instantaneous bursts of incremental amounts of steam at harmonic intervals to the oscillating water and 12 is a stainless slotted rod, which, when rotated slightly aligns slots on its surface to allow steam to pass through 11 into a partly filled arm of water moving downwardly so momentum is harmonically increased. Since the basin shape uses a minimum of reciprocating water to steam condensed, the design is efficient. The flywheel effect of oscillating water is reenforced in this design by the long length of turbine drive shaft and attached blades held between discs to which they are likewise welded. This is shown in FIG. 15 which is a longitudinal, vertical cross section through the turbine wheel 6 of FIG. 13. The continuously rotating mass of water during oscillation reversals also provides flywheel effect.

In FIG. 15 the hydroelectric turbine is made up of the turbine 1, and the pair or electric generators 2 all of which are supported on reenforced concrete bases 3 resting on earth 4. The long turbine shaft 5 extends between the electric generators through suitable couplings and passes through the oscillating basins illustrated in FIG. 13 and through the walls 3 of the concrete structure shown in the plan view of FIG. 14. Surrounding the turbine shaft are successive lengths of stainless steel tube 6. Circular stainless steel reenforcing discs 7 are welded to both the turbine shaft and the lengths of hollow tube. All these must be of steel plate thick enough to stand the strains imposed by continuous operation and supported on the shaft 5 riding on bearings 9, 10 and 11. The hollow tube sections 6 are valuable not only for attachment to vanes 7 but also to help float the rotating structure and thus take weight off bearings 9 which must be oil free and of self lubricating type such as bronze impregnated with graphite. Similarly the vanes 7 may be made hollow to lessen weight on bearings. Bearings 10 must withstand leakage of water out of the structure and into the underground structure housing the electric generators 2 the heat from which should be used to warm the water used for oscillation thus recovering the electrical loss in a novel manner.

Although the behavior of wet steam introduced into the vacuum chamber of this invention is complex, it should be possible to predict conditions from the steam tables of saturated steam and the following Table I is presented for those wishing to choose a design similar to those illustrated in FIGS. 13, 14 and 15. A pair of roof areas having a base of 100 ft. and height of 18 ft. is selected so the center of gravity of water in the left triangular arm need fall only six feet to where water levels in both arms are the same and so top velocity is reached and kinetic energy at a maximum. In Table I a building length of 96.4 length is chosen merely to show the number of times saturated steam would be expanded if the triangular face were 18 feet high which the Table I indicates would be 32.38 times which should comfortably extract all the heat of condensation of 100 pounds of saturated steam at 212° F. were added to one arm each second or to both arms in two seconds. The oscillation is classed as a driven and damped type. The turbines damp the force. Steam additions drive it.

TABLE I

TEMPERATURES, PRESSURES AND VOLUMES OF 100 POUNDS OF SATURATED STEAM EXPANDING FROM 212° F., 14.7 psia AND 2680 cu ft. AS INDICATED BELOW

| (from steam tables) | | | NUMBER TIMES | HEIGHT OF TRIANGULAR SEGMENTS TO EQUAL (C) FIG. 13 TRIANGLE TOTAL 6 × 18 ft. face × 96.4 ft | |
|---|---|---|---|---|---|
| °F. (A) | psia (B) | cu ft. (C) | EXPANDED (D) | (E) = the square root of (C)/1/2 base × height × 96.4 | |
| 120 | 1.69 | 20,318 | 7.51 | 8.71 | DERIVATION OF |
| 100 | 0.95 | 35,022 | 13.06 | 11.44 | ABOVE FORMULA (E) |
| 90 | 0.70 | 46,790 | 17.45 | 13.22 | base × height |
| 80 | 0.51 | 63,303 | 23.62 | 15.37 | Area = 2 = |
| 70 | 0.36 | 86,795 | 32.38 | 18.00 | 50 × (18 = H) |
| 60 | 0.27 | 120,710 | 45.04 | 21.23 | 50/18 = 2.778 so |
| 50 | 0.18 | 170,430 | 63.59 | 25.23 | Areas = 2.778 × $H^2$ |
| | | | | | Volumes = $(C)_2$ = |
| | | | | | 96.4 × 2.778 × $H^2$ = |
| | | | | | 267.8 × $H^2$ thus |
| | | | | | (C)/267.8 = $H^2$ so |
| | | | | | 20,318/267.8 = 75.87 |
| | | | | | and (E) = 8.71 = H |

From the above it can be seen steam can be expanded 32.38 times from 2680 cu ft. at 212° F. and 14.7 psia to 86,795 cu ft. at 70° F. and 0.36 psia if the triangular section of FIG. 13 has a base of about 100 ft. and height of 18.00 ft. Of course, the triangular face could be higher and the length of building (length oscillating) shorter. Little can be gained by expanding beyond the point of recovering heat of condensation. The condensed water is withdrawn continuously to serve as boiler feedwater which must be preheated by steam extraction at various stages in the steam turbines.

Although FIG. 13 roof construction is shown triangular in cross section for the purpose of illustrating the above calculations, all parts of the oscillating water container need to be smooth curves to prevent erosion akin to water hammer effects. The enormous advantages of the oscillating basin design of 13, 14 and 15 over that of the U-tube of FIG. 3 or FIGS. 6, 7 and 8 is the reduction in velocity of water to get the same displacement capacity of water via which steam may be expanded to produce hydroelectric power.

Again it must be emphasized that the expansion of steam at low temperatures and pressures can not be that derived from steam tables of saturated (dry) steam so TABLE I above can not represent the conditions in the practice of this invention. A better visualization may be obtained from the Mark's Standard Handbook 8th Edition 1979 discussion of Temperature-entropy diagram for steam page 4–24 wherein FIG. 18 Data is stated from Keenan and Keyes "Thermodynamic Properties of Steam", Wiley. There the rapid drop in quality of steam shows its departure from a saturated state to a condensed state wherein latent heat of condensation is being released to sustain the temperature of the molecules remaining as steam or raise the surface temperature of the water which itself is evaporating in the final vacuum achieved.

This invention likewise discloses that, power plant condensers wherein steam is conventionally condensed by water drawn from lakes, streams or the ocean and made obsolete by the oscillating power of this invention, may be used to vaporize a refrigerant whose vapors may be used to operate the apparatus of this invention to produce additional power thus cooling the water from lakes, streams or the ocean instead of heating it. Thus use of 300 tons of water per ton of coal currently used to heat water 19° F. may be used to cool it 20° F. and the $300 \times 2000 \times 20 = 12{,}000{,}000$ BTUs per ton of coal converted to hydroelectric power. Some coal has only 24,000,000 Btus recoverable per ton burned in a power plant so possible savings by retrofit are enormous.

Where U-tubes are referred to in the specification or claims of this invention it is meant to cover all shapes in which water may be oscillated to practice the invention excepting where a precise shape of apparatus is described and illustrated and even then obvious improvements in one shape adaptable to other shapes are purposely omitted to avoid excess repetition. Particularly the trough-like shapes of Drawings 13, 14 and 15 may be considered elongated U-tubes. A U-tube is not to be assumed having a circular cross section or arms to be cylindrical unless so described and illustrated. Obviously the invention may be practiced with a variety of shapes.

What is claimed:

1. Apparatus for recovery of mechanical energy from steam exhausted from a power plant or the like, comprising:

a generally U-shaped sealed resevoir, having legs connected by and extending generally upwardly from a bight portion, said legs and said bight portion being essentially unobstructed and of generally comparable cross-sectional areas, means for alternately releasing said steam into the ends of the legs of said U-shaped reservoir, such that said steam condenses in said reservoir substantially immediately, whereby a quantity of water is driven back and forth between said legs through said bight portion connecting said legs at the resonant frequency of the system, means for removing condensed water from said reservoir, and means disposed in said reservoir for recovery of mechanical energy from the flow of water back and forth in said bight portion.

2. The apparatus of claim 1 wherein said legs of said resevoir extend generally vertically.

3. The appartus of claim 2 further comprising float means disposed in each of said legs and adapted to float atop the condensed water therein.

4. The device according to claim 1 including means for converting the mechanical energy into electrical energy.

5. The apparatus of claim 4 wherein said means for recovery of mechanical energy comprises turbine means.

6. The apparatus of claim 5 comprising electrical generator means connected to said turbine means.

7. A method for obtaining energy from steam exhausted from a power plant or the like, comprising the steps of:

providing a U-shaped tube having two legs connected by and extending upwardly from a bight portion, the cross-sectional areas of said legs and said bight portion being substantially uniform;

connecting the ends of the legs of the U to the steam exhaust from said power plant or the like by way of valve means;

controlling said valve means so as to alternately release steam into said legs, such that said steam is permitted to expand in said legs, whereby condensed water in said U-shaped tube is alternately driven back and forth through said bight portion;

withdrawing condensed water from said tube as needed to provide appropriate volumes for expansion of said steam thereinto; and disposing means for recovery of mechanical energy from flow of water said in said bight portion and operating said means for recovery to recover mechanical energy from said flow of condensed water back and forth through said bight portion.

8. The method of claim 7, wherein said steam is admitted into said legs of said resevoir at intervals such that the condensed water within said resevoir is driven back and forth at the resonant frequency of the water/-reservoir system.

9. The apparatus of claim 8 wherein the legs of said U-shaped reservoir are aligned generally vertically.

10. The method of claim 7 further comprising the step of disposing float means in each of said legs of said reservoir such that said float means float atop the columns of condensed water therein.

11. The apparatus of claim 7 comprising the additinal step of connecting electrical generator means to said means for recovery of mechanical energy from flow of said water back and forth through said bight portion.

12. The process of claim 7 in which the power plant is fired with fossil fuel.

13. The process of claim 7 in which the power plant is fired with nuclear power.

* * * * *